US006260217B1

(12) United States Patent
Loft, Jr.

(10) Patent No.: US 6,260,217 B1
(45) Date of Patent: Jul. 17, 2001

(54) WINTER SWIMMING POOL COVER AND DRAINAGE DEVICE

(76) Inventor: Dudley J. Loft, Jr., 3986 Summerway La., Hamburg, NY (US) 14075

( * ) Notice: Subject to any disclaimer, the term of this patent is extended or adjusted under 35 U.S.C. 154(b) by 0 days.

(21) Appl. No.: 09/624,534

(22) Filed: Jul. 24, 2000

Related U.S. Application Data

(60) Provisional application No. 60/191,337, filed on Mar. 22, 2000.

(51) Int. Cl.[7] ..... E04H 4/06
(52) U.S. Cl. ..... 4/498
(58) Field of Search ..... 4/496, 498

(56) References Cited

U.S. PATENT DOCUMENTS 3,184,764 5/1965 West .
4,819,681 4/1989 Hodak .
5,802,629 9/1998 Zietek .
5,946,743 9/1999 Hashmi .

*Primary Examiner*—Robert M. Fetsuga
(74) *Attorney, Agent, or Firm*—Jaeckle Fleischmann & Mugel, LLP

(57) ABSTRACT

In an improved cover and drainage device for a swimming pool, the cover has an upper surface sealably connected to a drain that enables accumulated water on the surface to drain into a sealably connected drainage conduit disposed within the pool. The conduit extends through a pipe attached to an external surface of a side wall of the pool and terminates in a water discharge outlet external to the pool. The improvement comprises flexible means for sealably securing the drainage conduit to the pipe, thereby enabling movement of the conduit relative to the pipe.

9 Claims, 1 Drawing Sheet

WINTER SWIMMING POOL COVER AND DRAINAGE DEVICE

CROSS-REFERENCE TO RELATED APPLICATIONS

This application is a conversion application of U.S. Provisional Patent Application Serial No. 60/191,337, filed Mar. 22, 2000 (Attorney Docket No. 89399.067300).

FIELD OF THE INVENTION

The present invention relates to swimming pool covers and, more particularly, to a swimming pool cover that provides for the drainage of water from its surface.

BACKGROUND OF THE INVENTION

For reasons of structural stability and/or economy, swimming pools of both the in-ground and above-ground type are generally kept filled with water, even when the temperatures are too cold for swimming. During the cold off-season months, swimming pools are typically provided with flexible covers that prevent falling or windblown leaves and other kinds of debris from contaminating the water remaining in the pool. The cover thus keeps the water relatively clean and free of extraneous matter, which greatly facilitates the preparation of the pool for the resumption of swimming on the arrival of warm weather.

Over the winter months, however, excessive amounts of water from rain or melted snow can accumulate on the surface of the swimming pool cover. Before the cover can be removed, the bulk of the water must be laboriously removed, while ensuring that any debris deposited on the surface not be allowed to fall into the pool. An even more undesirable situation obtains when the weight of the accumulated water on the surface of the cover is so great as to cause its rupture, resulting not only in the destruction of the cover but in the contamination of the pool water, which the cover was intended to prevent.

A variety of solutions have been proposed to address the just discussed problems. For example, West, U.S. Pat. No. 3,184,764, describes a flexible swimming pool cover that includes a centrally located water-receiving well that is covered with a screen and provided with a drain opening that can be connected to a drainage hose.

Hodak, U.S. Pat. No. 4,819,681, discloses an apparatus and method for draining a swimming pool cover that includes a drain passage placed through a hole in a swimming pool cover and having an inlet end whose height above the cover can be adjusted to regulate the amount of water that accumulates on the surface of the cover. The drain passage is connected with a conduit that is, in turn, attached to a port in the side wall of the swimming pool.

Zietek, U.S. Pat. No. 5,802,629, describes a self-draining swimming pool cover having a drain fitting attached to a hole in the cover, a first hose extending from the drain fitting to an outlet in the pool side wall, and a second hose on the other side of the side wall for directing the disposal of the drained water.

Hashmi, U.S. Pat. No. 5,946,743, discloses a kit for converting a standard pool cover into a self-draining cover, by which a collar is sealably connected to a hole cut in the cover by screw threads, a corresponding internally threaded nut, and a rubber grommet. The collar is attached to a hose that is connected at its other end to the skimmer of the pool.

Prior art apparatus for draining a pool cover typically include a conduit connected by a rigid fitting to the interior side wall of the pool. Freezing of the water around such fittings may result in significant damage to the pool wall. The possibility of such damage is avoided by the pool cover and drainage device of the present invention

SUMMARY OF THE INVENTION

The present invention is directed to an improved cover and drainage device for a swimming pool. The cover has an upper surface sealably connected to a drain that enables accumulated water on the surface to drain into a sealably connected drainage conduit disposed within the pool. The conduit extends through a pipe attached to an external surface of a side wall of the pool and terminates in a water discharge outlet external to the pool. The improvement comprises flexible means for sealably securing the drainage conduit to the pipe, thereby enabling movement of the conduit relative to the pipe.

DESCRIPTION OF THE INVENTION

Figure 1:
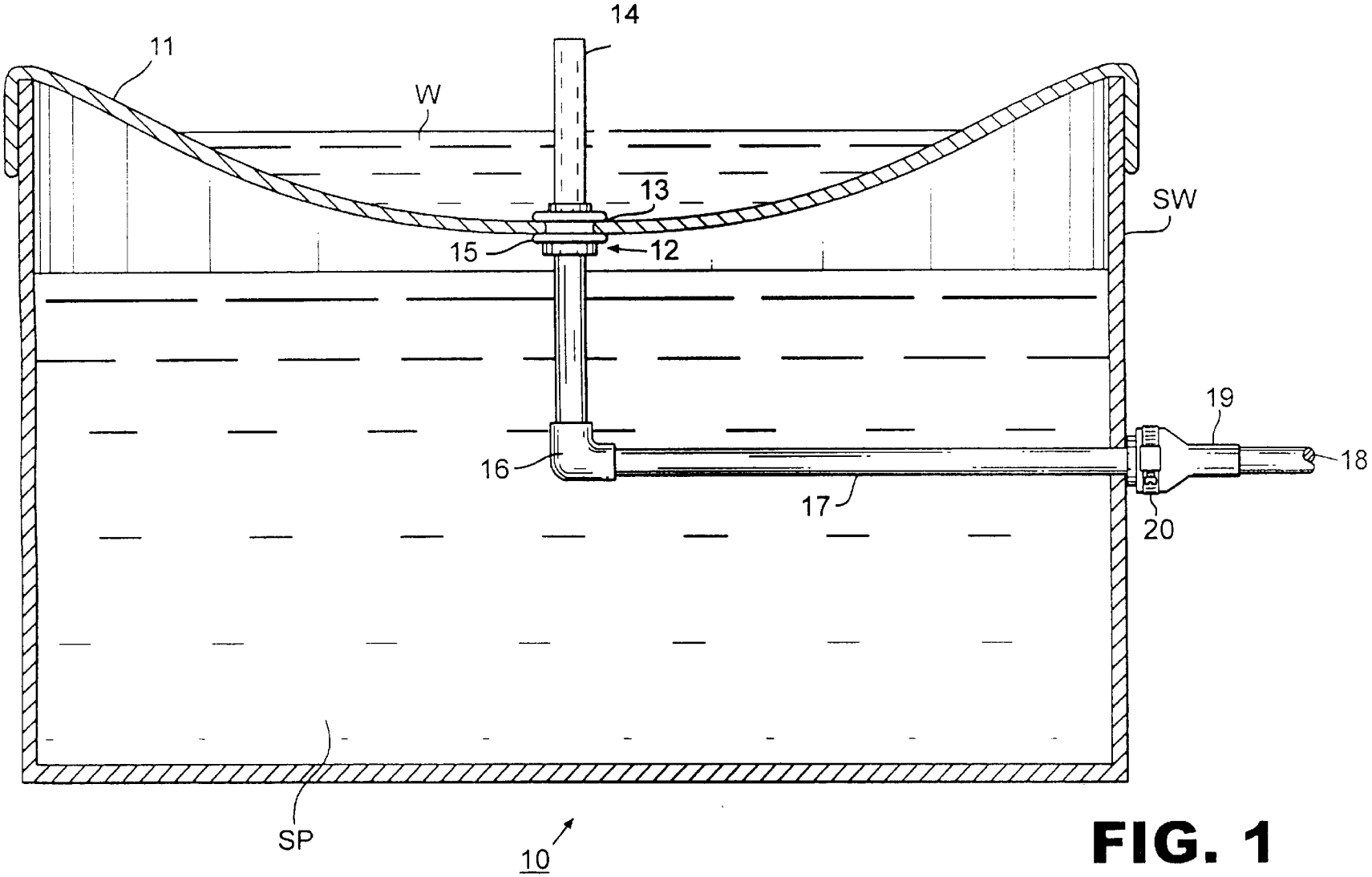
FIG. 1 is a schematic illustration of a pool cover and drainage device in accordance with the present invention.

As depicted in FIG. 1, a swimming pool SP is provided with a pool cover and drain device 10 of the present invention. Water W that accumulates on a pool cover 11 flows through a drain 12 that preferably is located at a lowermost point 13 of pool cover 11. Drain 12 preferably comprises a tube 14 sealably connected to cover 11 by a threaded connector 15 that may further comprise rubber gaskets (not shown). Tube 14 may be further provided with an elbow fitting 16 for connection with a drainage conduit 17. Tube 14, preferably a 12" long slotted collector tube, is, along with threaded connector 15 and elbow fitting 16, available from swimming pool supply companies such as Hayward Pool Products, Inc, Elizabeth N.J.

Drainage conduit 17, which preferably comprises a flexible hose, for example, a ¾" diameter rubber hose, extends through a pipe P attached externally to a side wall SW of pool SP and terminates in a water discharge outlet 18. Outlet 18 may, if desired, be provided with a suction pump (not shown) for removing water from conduit 17 and pool cover 11. Conduit 17 is sealably connected by flexible means to pipe P, which preferably is a an inlet fitting located on side wall SW at a level below that of a skimmer (not shown). The flexible means connecting conduit 17 to pipe P can be a snugly fitting rubber sleeve 19, for example, a piece of rubber tubing or a portion of a finger cut from a rubber glove. A clamp 20, for example, a metal strap with a tightening screw, may be used to secure sleeve 19 to pipe P. The flexibility of rubber sleeve 19 enables movement of conduit 17 within pipe P, such as might be caused by freezing and thawing of water in pool SP. Conduit 17 may thus move relative to pipe P without breaking the seal between them, thereby preventing the leakage of water. Furthermore, because the flexible seal is external to swimming pool SP, there is no possibility of damage to pool side wall SW caused by the alternate freezing and thawing of water.

The invention has been described in detail for the purpose of illustration, but it is to be understood that such detail is solely for that purpose, and variations can be made by those skilled in the art without departing from the spirit and scope of the invention, which is defined by the following claims.

What is claimed is:

1. In an improved cover and drainage device for a swimming pool, said cover having an upper surface sealably connected to a drain for enabling drainage of accumulated water from said surface into a drainage conduit disposed within said pool and sealably connected to said drain, said conduit extending through a pipe attached to an external surface of a side wall of such pool and terminating in a water discharge outlet external to said pool, wherein the improvement comprises:

flexible means for sealably securing said drainage conduit to said pipe, thereby enabling movement of said drainage conduit relative to said pipe.

2. The cover and drainage device of claim 1 wherein said conduit comprises a flexible hose.

3. The cover and drainage device of claim 1 wherein said flexible means comprises a rubber sleeve placed over said drainage conduit and said pipe.

4. The cover and drainage device of claim 3 wherein said flexible means further comprises a clamp for securing said rubber sleeve to said pipe.

5. The cover and drainage device of claim 1 wherein said drain is located above said outlet, thereby enabling draining said upper surface using the force of gravity.

6. The cover and drainage device of claim 1 wherein said pipe comprises a pool inlet fitting.

7. The cover and drainage device of claim 1 wherein said cover is flexible and said drain is disposed at a lowermost point of said upper surface of said cover.

8. The cover and drainage device of claim 1 further comprising a suction pump coupled to said outlet of said discharge conduit for removing water from said conduit and from said upper surface of said cover.

9. The cover and drainage device of claim 1 wherein said drain comprises a tube extending through said cover and sealably connected to said cover by a threaded connector comprising rubber gaskets.

* * * * *